US009206549B2

(12) United States Patent
Cederloef et al.

(10) Patent No.: US 9,206,549 B2
(45) Date of Patent: Dec. 8, 2015

(54) STEEL-MADE YANKEE CYLINDER

(71) Applicant: Valmet Aktiebolag, Sundsvall (SE)

(72) Inventors: Jonas Cederloef, Karlstad (SE); Hans Ivarsson, Karlstad (SE); Andreas Hjaertqvist, Grums (SE); Magnus Hoegman, Kil (SE); Stefan Moden, Kil (SE); Johnny Anerud, Karlstad (SE); Stefan Thyberg, Karlstad (SE); Sune Wendelsson, Karlstad (SE); Martin Raedman, Kil (SE); Anna Danielsson, Karlstad (SE)

(73) Assignee: Valmet Aktiebolag, Sundsvall (SE)

( * ) Notice: Subject to any disclaimer, the term of this patent is extended or adjusted under 35 U.S.C. 154(b) by 0 days.

(21) Appl. No.: 14/427,225

(22) PCT Filed: Nov. 5, 2013

(86) PCT No.: PCT/SE2013/051290

§ 371 (c)(1),
(2) Date: Mar. 10, 2015

(87) PCT Pub. No.: WO2014/077761

PCT Pub. Date: May 22, 2014

(65) Prior Publication Data

US 2015/0240420 A1 Aug. 27, 2015

(30) Foreign Application Priority Data

Nov. 13, 2012 (SE) ..... 1251287

(51) Int. Cl.

| | |
|---|---|
| ***D21F 5/18*** | (2006.01) |
| ***F26B 13/18*** | (2006.01) |
| ***D21F 5/02*** | (2006.01) |

(52) U.S. Cl.

CPC ..... *D21F 5/181* (2013.01); *D21F 5/021* (2013.01); *F26B 13/18* (2013.01); *F26B 13/183* (2013.01)

(58) Field of Classification Search

CPC ..... F26B 11/00; F26B 11/02; F26B 13/00; F26B 13/18; F26B 13/183; D21F 5/00; D21F 5/18; D21F 5/181; F82F 27/00

USPC ..... 34/117, 120, 124; 162/289, 358, 359; 165/89

See application file for complete search history.

(56) References Cited

U.S. PATENT DOCUMENTS

| | | | | |
|---|---|---|---|---|
| 3,258,851 A | | 7/1966 | Vonderau | |
| 3,633,662 A | * | 1/1972 | Voll | D06C 15/08 165/89 |

(Continued)

FOREIGN PATENT DOCUMENTS

| | | | |
|---|---|---|---|
| CN | 203977226 U | * | 12/2014 |
| EP | 2126203 | | 12/2009 |

(Continued)

OTHER PUBLICATIONS

International Searching Authority, International Search Report and Written Opinion for International Application No. PCT/SE2013/051290, Feb. 18, 2014, 10 pages, Swedish Patent and Registration Office, Sweden.

*Primary Examiner* — Stephen M Gravini

(74) *Attorney, Agent, or Firm* — Alston & Bird LLP

(57) ABSTRACT

The invention relates to a steel-made Yankee cylinder (1) that comprises a cylindrical shell (2) having two axial ends (3, 4). An end wall (5, 6) is connected to each axial end (3, 4) by a circumferential weld bead (7). The cylindrical shell has an inner surface (8) in which circumferential grooves (9*a*, 9*b*, 9*c*, 9*d*, 9*e*) are formed. From the outermost circumferential groove (9*a*) at each axial end (3, 4) to the circumferential weld bead (7) at that axial end (3, 4) the wall thickness (T) of the cylindrical shell is either constant or decreasing and the depth (d1) of the circumferential grooves increases axially from the outermost circumferential groove (9*a*).

6 Claims, 2 Drawing Sheets

(56) References Cited

U.S. PATENT DOCUMENTS 3,808,700 A * 5/1974 Kraus ..... D21F 5/02 165/89
4,320,582 A * 3/1982 Klippstein ..... D21F 5/021 165/89
6,387,217 B1 * 5/2002 Edwards ..... D21F 3/0218 162/161
6,683,284 B2 * 1/2004 Nyman ..... D21F 5/022 165/89
6,877,246 B1 * 4/2005 Hada ..... D21F 5/182 34/119
7,614,161 B2 * 11/2009 Haurie ..... F26B 13/183 162/359.1
8,127,462 B2 * 3/2012 Haurie ..... F26B 13/183 100/328
8,398,822 B2 * 3/2013 Mennucci ..... D21F 5/021 162/357
8,919,008 B2 * 12/2014 Baubock ..... D21F 5/021 34/119
8,959,790 B2 * 2/2015 Anerud ..... F16L 3/00 162/359.1
2003/0178406 A1 * 9/2003 Nyman ..... D21F 5/022 219/469
2008/0005921 A1 * 1/2008 Gruber-Nadlinger .... D21F 5/02 34/108
2008/0156450 A1 * 7/2008 Klerelid ..... D21F 7/08 162/203
2013/0153075 A1 * 6/2013 Anerud ..... F16L 3/00 138/106
2013/0174437 A1 * 7/2013 Anerud ..... D21F 5/10 34/119
2015/0240420 A1 * 8/2015 Cederloef ..... D21F 5/181 162/289

FOREIGN PATENT DOCUMENTS

SE WO 9417968 A1 * 8/1994 ..... B26B 9/00
SE WO 9837945 A1 * 9/1998 ..... B01D 46/0005
SE WO 2008051150 A1 * 5/2008 ..... D21F 7/08
SE WO 2014077761 A1 * 5/2014 ..... F26B 13/183
SU 427122 A1 5/1974
WO WO 2008/105005 A1 9/2008

* cited by examiner

STEEL-MADE YANKEE CYLINDER

CROSS REFERENCE TO RELATED APPLICATIONS

This application is a National Stage Application, filed under 35 U.S.C. §371, of International Application No. PCT/SE2013/051290, filed Nov. 5, 2013, which claims priority to Swedish Application No. 1251287-7, filed Nov. 13, 2012; the contents of both of which as are hereby incorporated by reference in their entirety.

BACKGROUND

1. Related Field

The present invention relates to a steel-made Yankee cylinder having a cylindrical shell and end walls welded to the axial ends of the cylindrical shell.

2. Description of Related Art

In a paper making machine for making tissue paper, a newly formed fibrous web which is still wet is dried on a Yankee drying cylinder. The Yankee drying cylinder is typically filled with hot steam which may have a temperature of up to 180° C. or even more. The hot steam heats the Yankee drying cylinder such that the external surface of the Yankee cylinder reaches a temperature suitable for effective evaporation of water in a wet fibrous web such as a tissue paper web. The steam is normally pressurized to such an extent that the Yankee cylinder is subjected to substantial mechanical stress due to the internal pressure. The overpressure inside the Yankee cylinder during operation may be about 1 MPa (10 bar).

The weight of the Yankee cylinder as well as centrifugal forces may also contribute to the mechanical stress. The Yankee cylinder must be made to withstand such mechanical stress. Yankee drying cylinders have usually been made of cast iron but it is known that a Yankee cylinder can also be made of welded steel. EP 2126203 discloses a Yankee cylinder for drying paper which is made of steel and has a cylindrical shell joined to two ends through a respective circumferential weld bead made between opposing surfaces of each end and the cylindrical shell. The cylindrical shell is made such that, close to each of its end edges, it has a portion of cylindrical wall of a thickness gradually increasing from a zone of minimum thickness to a zone of maximum thickness in correspondence of which the circumferential weld bead is formed.

In addition to being strong enough to withstand mechanical stress, a Yankee drying cylinder should preferably also be easy to manufacture. Therefore, it is an object of the present invention to provide a design of a Yankee drying cylinder that allows the Yankee drying cylinder to be manufactured.

BRIEF SUMMARY

The inventive Yankee cylinder is a steel-made Yankee cylinder that comprises a cylindrical shell having two axial ends. An end wall is connected to each axial end by means of a circumferential weld bead. The cylindrical shell further has an inner surface in which circumferential grooves are formed. From the outermost circumferential groove at each axial end to the circumferential bead at that axial end, the wall thickness of the cylindrical shell is either constant or decreasing and the outermost circumferential groove at each axial end of the cylindrical shell is less deep than the next circumferential groove.

In embodiments of the invention, the cylindrical shell may be designed such that, at each axial end, the wall thickness of the cylindrical shell decreases in the area from the outermost circumferential groove to the circumferential weld bead.

In advantageous embodiments of the invention, the depth of the circumferential grooves increases in at least three steps from the outermost circumferential groove to a region between the axial ends of the cylindrical shell where the circumferential grooves have the same depth.

In the area of the circumferential grooves, the total wall thickness is preferably constant.

The outermost circumferential groove at each axial end of the cylindrical shell may have a depth of 8 mm-12 mm and the next circumferential groove may have a depth of 13 mm-17 mm.

In embodiments of the invention, the thickness of the cylindrical shell in that part of the cylindrical shell that is provided with circumferential grooves may be in the range of 20 mm-100 mm. In this context, a thickness of 20 mm would be regarded as a very small thickness while 100 mm would be a very high value for thickness. The values 20 mm and 100 mm should therefore be understood as extreme values for shell thickness (but not impossible). In many realistic embodiments, the thickness would be somewhere in the range of 30 mm-70 mm and preferably in the range of 40 mm-55 mm.

DETAILED DESCRIPTION OF VARIOUS EMBODIMENTS

Figure 1:
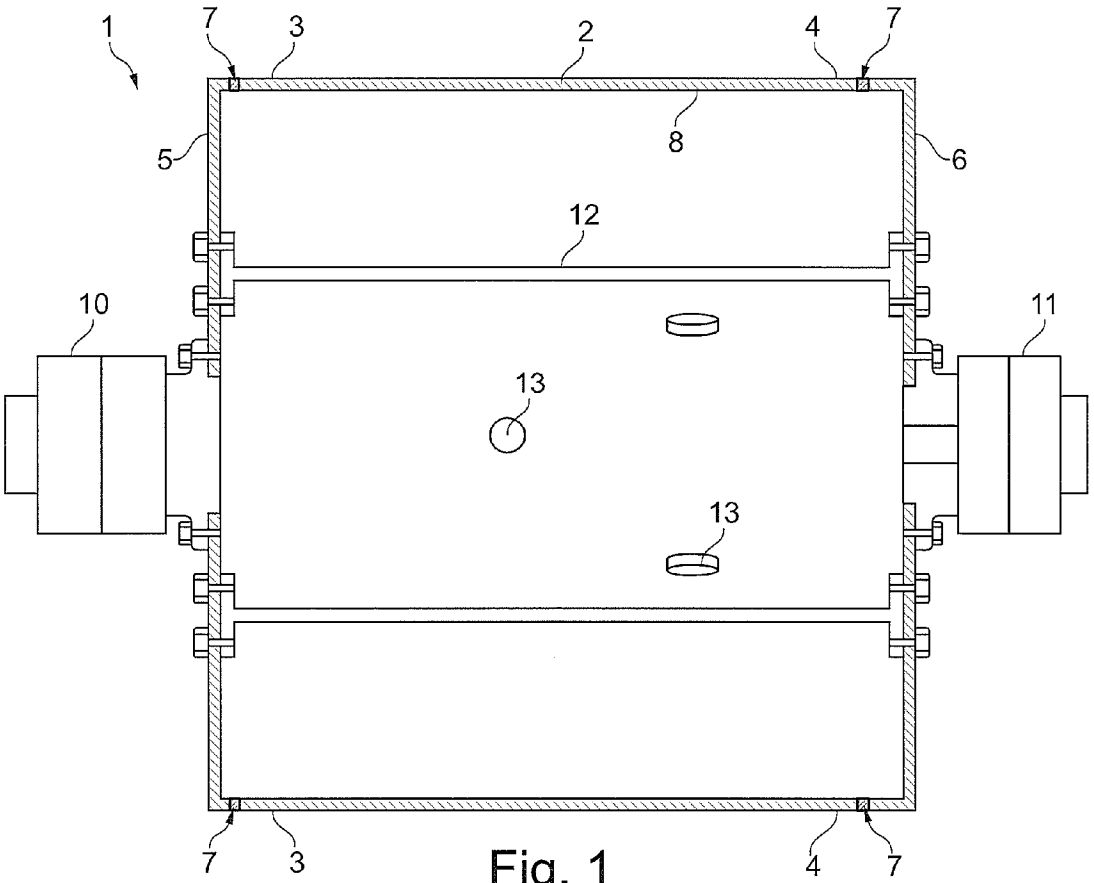
FIG. 1 shows a longitudinal section of a Yankee drying cylinder.

With reference to FIG. 1, the inventive Yankee cylinder 1 comprises a cylindrical shell 2. The cylindrical shell 2 is made of steel. The steel used could be any kind of steel, for example carbon steel or stainless steel. The steel used may be, for example, rolled steel. For example, it may be steel that has been hot rolled and/or cold rolled. The cylindrical shell 2 may optionally be composed of several sheets of rolled metal that have been welded together. The cylindrical shell 2 has axial ends 3, 4. An end wall 5, 6 is connected to each axial end 3, 4 by means of a circumferential weld bead 7. The end walls 5, 6 are also made of steel and may be made of the same steel material as the cylindrical shell 2.

In FIG. 1, it can be seen how the Yankee cylinder 1 has journals 10, 11. During operation, the interior of the Yankee cylinder 1 will be filled with hot steam. The hot steam can be supplied, for example, through the journals 10, 11.

Inside the cylindrical shell 2, there may be an internal tie 12 which is provided with holes 13, for the passage of ducts of a condensate removal system (not shown). For an example of a condensate removal system, reference is made to WO 2012/033442 A1.

Figure 2:
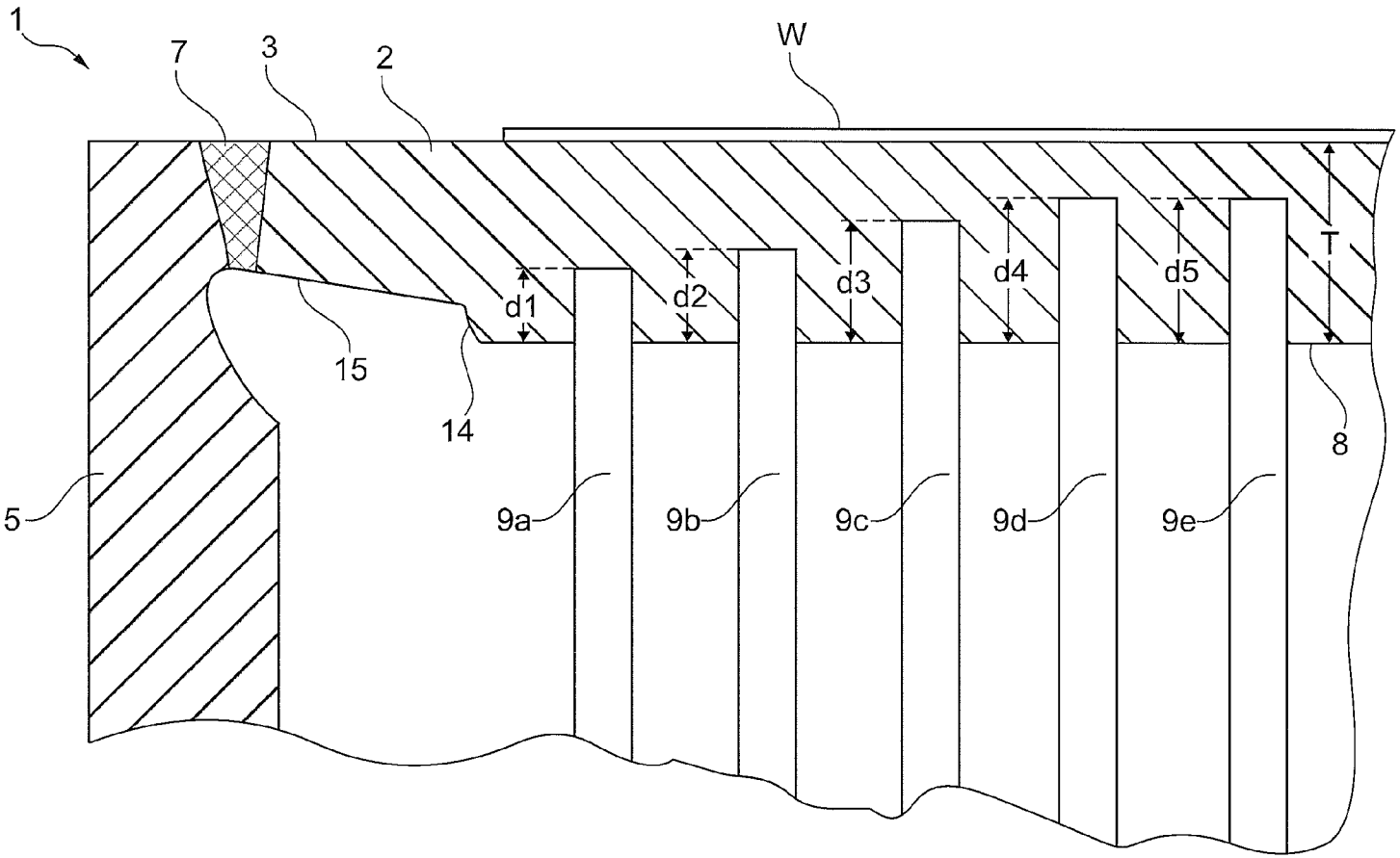
FIG. 2 shows an enlargement of a portion of a Yankee cylinder where the cylindrical shell of the Yankee cylinder has been welded to an end wall.

With reference to FIG. 2, a wet fibrous web W can be caused to run over the surface of the cylindrical shell 2 such that water contained in the wet fibrous web W is evaporated.

In the inventive Yankee cylinder, the cylindrical shell 2 has an inner surface 8. With reference to FIG. 2, circumferential grooves 9*a*, 9*b*, 9*c*, 9*d*, 9*e* are formed in the inner surface 8 of the cylindrical shell 2. In the circumferential grooves 9*a*, 9*b*, 9*c*, 9*d*, 9*e*, hot steam is condensed and heat energy is transferred to the outer surface of the Yankee cylinder 1 such that water in the fibrous web W is evaporated. The circumferential grooves 9*a*, 9*b*, 9*c*, 9*d*, 9*e* thus serve to facilitate heat transfer such that the fibrous web W which is passed over the Yankee cylinder is dried by evaporation.

As can be seen in FIG. 2, there is a circumferential groove 9*a* which is the outermost circumferential groove at an axial end 3 of the cylindrical shell 2. Beyond that circumferential groove 9*a* which is the outermost groove, the wall of the cylindrical shell 2 extends a certain distance to an axial end 3 of the cylindrical shell 2 where the cylindrical shell 2 is joined to the end wall 5 by a circumferential weld bead 7. It has been suggested that this part of the cylindrical shell 2 should increase in thickness T towards the area of the circumferential weld bead 7. However, manufacturing of the cylindrical shell 2 becomes more complicated if this part of the cylindrical shell is to increase its thickness T towards the axial end of the cylindrical shell 2. The manufacturing operation becomes easier if the thickness T of the wall can remain constant from the outermost circumferential groove 9*a* to the axial end 3. Also in the case where the thickness T of the cylindrical shell 2 decreases from the outermost circumferential groove 9*a* to the axial end 3, the manufacturing will be easier than if the thickness T is to increase. Machining the inner surface 8 such that the thickness T decreases towards the axial end 3 is less complicated than creating a profile where the thickness T increases.

Therefore, the cylindrical shell 2 of the inventive Yankee cylinder has been given such a profile that, from the outermost circumferential groove 9*a* at the axial end 3 to the circumferential weld bead 7 at the axial end 3, 4, the wall thickness T of the cylindrical shell 2 is either constant or decreasing. In the embodiment shown in FIG. 2, the wall thickness T is initially constant in the area axially immediately outside the outermost circumferential groove 9*a*. Thereafter, the wall thickness T decreases towards the circumferential weld bead. Embodiments are conceivable in which the wall thickness T is constant all the way from the outermost circumferential groove 9*a* to the circumferential weld bead 7 but embodiments are also conceivable in which the wall thickness T decreases the whole way or substantially the whole way from the outermost circumferential groove 9*a* to the circumferential weld bead 7. In practical embodiments contemplated by the inventors, the wall thickness T may decrease linearly towards the axial end 3 by an angle $\alpha$ of 1°. The wall thickness T may thus decrease over at least a part of the distance between the outermost circumferential groove 9*a* and the circumferential weld bead 7 and possibly over the whole distance. In FIG. 2, an embodiment is shown in which the wall thickness T first remains constant and then decreases in the direction towards the circumferential weld bead 7.

If the wall thickness T does not increase towards the axial ends 3, 4, there would be a risk that the mechanical stress in the cylindrical shell 2 should have peak at the outermost axial groove 9*a* if the outermost circumferential groove 9*a* were to have the full depth d that would normally be considered as necessary for the transfer of heat energy. To avoid such pressure peaks (peaks in the mechanical stress that the cylindrical shell 2 is subjected to), the cylindrical shell 2 has been given such a profile that the outermost circumferential groove 9*a* is less deep than the next circumferential groove 9*b* (i.e. the groove 9*b* which is immediately adjacent the outermost groove 9*a*). In other words, the outermost circumferential groove 9*a* at each axial end 3, 4 of the cylindrical shell 2 has a depth d1 which is smaller than the depth d2 of the next circumferential groove 9*b*.

Preferably, the depth of the circumferential grooves 9*a*, 9*b*, 9*c*, 9*d*, 9*e* should increase gradually in order minimize peaks in the mechanical pressure. Preferably, the depth d1, d2, d3, d4, d5 of the circumferential grooves 9*a*, 9*b*, 9*c*, 9*d*, 9*e* increases in at least three steps from the outermost circumferential groove 9*a* to a region between the axial ends 3, 4 of the cylindrical shell 2 where the circumferential grooves 9*a*, 9*b*, 9*c*, 9*d*, 9*e* have the same depth. With reference to FIG. 2, it can be seen that the outermost circumferential groove 9*a* has a depth d1 which is quite small. The next circumferential groove 9*a* has a depth d2 which is somewhat greater than the depth d1 of the outermost circumferential groove 9*a*. The next circumferential groove 9*c* in the axial direction (i.e. the circumferential groove 9*c* that follows the circumferential groove 9*b* which is adjacent the outermost circumferential groove 9*a* has a depth d3 which is greater than the depth d2 of the circumferential groove 9*b* that is adjacent the outermost circumferential groove. In FIG. 2, the next circumferential grove 9*d* has a depth which is even larger. It can thus be seen that, in the axial direction of the cylindrical shell 2 and in a direction away from the axial end 3, the depth d of the circumferential grooves 9*a*, 9*b*, 9*c*, 9*d*, 9*e* increase. In FIG. 2, the outermost circumferential groove 9*a* may be referred to as the first groove, the groove 9*b* which is adjacent the outermost groove 9*a* may be referred to as the second circumferential groove etc. It can then be seen how the first groove 9*a* has a depth d1 which is less than the depth d2 of the second groove 9*b* and that the second circumferential groove 9*b* has a depth d2 which is smaller than depth d3 the third circumferential groove 9*c*. In the same way, the depth d3 of the third circumferential groove 9*c* is smaller than the depth d4 of the fourth circumferential groove 9*d*. However, in the embodiment shown in FIG. 2, the depth d5 of the fifth circumferential groove 9*e* (i.e. the fifth circumferential groove in the direction away from the axial end 3 of the cylindrical shell 2. In the embodiment shown in FIG. 2, it can thus be seen that the depth of the circumferential grooves increases in three steps from the circumferential first groove 9*a* (i.e. the outermost circumferential groove) to the fourth circumferential groove 9*d*. Thereafter, the depth of the grooves may be constant until the other end of the cylindrical shell 2 where the depth of the circumferential grooves will decrease.

In FIG. 2 only one axial end 3 is shown. However, it should be understood that the profile at the other axial end 4 has been shaped in the same way. For the greater part of the inner surface 8 of the cylindrical shell 2, the circumferential grooves 9 have the same depth.

It should be understood that embodiments are conceivable in which the depth of the circumferential groves increases in only one step to the final depth of the grooves. In the same way, embodiments are conceivable in which the depth of the circumferential grooves increases in two steps, four steps, five steps or more than five steps.

In the area of the circumferential grooves 9*a*, 9*b*, 9*c*, 9*d*, 9*e*, the total wall thickness T is preferably constant although embodiments are conceivable in which this is not the case. For example, embodiments are conceivable in which the total wall thickness T is smaller or greater in that part of the cylindrical shell where the depth of the circumferential grooves increases. In this context, the total wall thickness T in the area of the circumferential grooves 9*a*, 9*b*, 9*c*, 9*d*, 9*e* etc. should be understood as the sum of the depth of a groove and the shortest distance from the bottom of that groove to the outer surface of the cylindrical shell 2.

Of course, in the area between the outermost circumferential groove 9*a* and the axial end 3 of the cylindrical shell 2, the thickness T does not have to be constant.

In many realistic embodiments, the outermost circumferential groove 9*a* at each axial end 3, 4 of the cylindrical shell 2 may have a depth of 8 mm-12 mm and the next circumferential groove 9) may have a depth of 13 mm-17 mm.

The total thickness T of the cylindrical shell 2 in that part of the cylindrical shell 2 that is provided with circumferential grooves 9*a*, 9*b*, 9*c*, 9*d*, 9*e* etc. may be in the range of 40 mm-55 mm.

In one practical embodiment contemplated by the inventors, the outermost circumferential groove 9*a* may have a depth d1 of 10 mm while the second circumferential groove 9*b* may have depth d2 of 15 mm, the third circumferential grove 9*c* a depth d3 of 20 mm while the fourth circumferential groove d4 may have a depth of 25 mm. At the same time, total wall thickness in the area of the circumferential grooves (including the depth of the grooves) may be 53 mm.

Thanks to the design of the inventive Yankee cylinder, the Yankee cylinder can be manufactured more easily. The difference in depth of the circumferential grooves at the axial ends do not cause any significant problem during manufacturing but the need to achieve an increasing thickness T of the cylindrical shell 2 towards the axial end 3 has been eliminated.

An additional bonus effect of the shallower grooves near the axial ends 3, 4 is the following. Immediately below the wet fibrous web W which is being dried on the Yankee drying cylinder, the surface temperature is much lower than the surface temperature of the Yankee drying cylinder in the area axially outside the wet fibrous web. The reason is that much heat energy is removed from the surface in the area under the wet web W. The evaporation of water in the web W consumes much of the thermal energy. As a realistic example, the following numerical values may be presented. If the temperature on the inside of the cylindrical shell 2 is about 180° C., the outer surface of the cylindrical shell 2 (i.e. the surface that contacts the fibrous web W) may have a temperature of about 95° C. in the area below the fibrous web. On the part of the outer surface of the cylindrical shell 2 that is axially outside the fibrous web W, the surface is not cooled and the surface temperature may be about 170° C.

Under such circumstances, the edges of the web W can receive heat energy both from below and from the hot areas axially outside the fibrous web W. This can lead to a difference in drying effect. Thanks to the shallower depth of the outermost circumferential grooves 9*a*, 9*b* in the inventive Yankee cylinder, the heating effect from below is somewhat reduced. As a result, the risk of uneven drying is reduced.

The lower wall thickness at the axial ends 3, 4 of the cylindrical shell also makes it easier to weld the cylindrical shell 2 to the end walls 5, 6.

In the embodiment of FIG. 2, the wall thickness T is initially constant in a direction towards the axial end 3. The part with constant thickness is then followed by a step 14 in which the wall thickness decreases. The step is then followed by a part 15 in which the wall thickness decreases linearly in a direction towards the axial end 3. It should be understood that embodiments are also conceivable in which the wall thickness starts to decrease immediately after the outermost circumferential groove 9*a*.

In the embodiment of FIG. 2, a realistic value for the distance from the outer edge of the end wall 5 to the edge of the fibrous web W may be 150 mm-290 mm in many practical embodiments (although both smaller and greater distances are possible). For example, the distance may be in the range of 160 mm-250 mm or in the range of 165 mm-220 mm. In one practical embodiment contemplated by the inventors, the distance from the outer end of the end wall 5 to the edge of the wet fibrous web W may be about 170 mm.

The thickness of the end walls 5, 6 may be on the order of about 80 mm-100 mm in many practical cases. For example, it may be 90 mm.

In many realistic embodiments of the invention, the inventive Yankee cylinder may have a diameter in the range of 3 m-6 m. However, Yankee cylinders are known that have a diameter that exceeds 6 m. In some cases, the diameter of the inventive Yankee cylinder may thus be even greater than 6 m. For example, at least one Yankee cylinder is known to the inventors that has a diameter of about 6.7 m and lager diameters can be envisaged. It is also known that a Yankee cylinder may have a diameter as small as 1.5 m. Therefore, the inventors consider that possible diameters for the inventive Yankee cylinder may very well lie in the range of 1.5 m-8 m or even be more than 8 m.

The invention claimed is:

1. A steel-made Yankee cylinder (1) comprising:

a cylindrical shell (2) having two axial ends (3, 4) and an inner surface (8) in which circumferential grooves (9*a*, 9*b*, 9*c*, 9*d*, 9*e*) are formed; and an end wall (5, 6) connected to each axial end (3, 4) by means of a circumferential weld bead (7), wherein:

from the outermost circumferential groove (9*a*) at each axial end (3, 4) to the circumferential weld bead (7) at that axial end (3, 4), the wall thickness (T) of the cylindrical shell (2) is at least one of constant or decreasing;

the outermost circumferential groove (9*a*) at each axial end (3, 4) of the cylindrical shell (2) has a depth (d1) which is smaller than the depth (d2) of the next circumferential groove (9*b*).

2. A steel-made Yankee cylinder (1) according to claim 1, wherein, at each axial end (3, 4), the wall thickness (T) of the cylindrical shell (2) decreases in the area from the outermost circumferential groove (9*a*) to the circumferential weld bead (7).

3. A steel-made Yankee cylinder (1) according to claim 1, wherein the depth (d1, d2, d3, d4, d5) of the circumferential grooves (9*a*, 9*b*, 9*c*, 9*d*, 9*e*) increases in at least three steps from the outermost circumferential groove (9*a*) to a region between the axial ends (3, 4) of the cylindrical shell (2) where the circumferential grooves (9*a*, 9*b*, 9*c*, 9*d*, 9*e*) have the same depth.

4. A steel-made Yankee cylinder according to claim 3, wherein, in the area of the circumferential grooves (9*a*, 9*b*, 9*c*, 9*d*, 9*e*), the total wall thickness (T) is constant.

5. A steel-made Yankee cylinder according to claim 3, wherein the outermost circumferential groove (9*a*) at each axial end (3, 4) of the cylindrical shell (2) has a depth of 8 mm-12 mm and the next circumferential groove (9*b*) has a depth of 13 mm-17 mm.

6. A steel-made Yankee cylinder according to claim 1, wherein the thickness of the cylindrical shell (2) in that part of the cylindrical shell (2) that is provided with circumferential grooves (9*a*, 9*b*, 9*c*, 9*d*, 9*e*) is in the range of 40 mm-55 mm.

* * * * *